US010408005B2

(12) United States Patent
Richards et al.

(10) Patent No.: US 10,408,005 B2
(45) Date of Patent: Sep. 10, 2019

(54) PACKER SETTING TOOL WITH INTERNAL PUMP

(71) Applicant: Halliburton Energy Services, Inc., Houston, TX (US)

(72) Inventors: William Mark Richards, Flower Mound, TX (US); Colby Munro Ross, Carrollton, TX (US); Thomas Owen Roane, Alvord, TX (US); William David Henderson, Tioga, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 323 days.

(21) Appl. No.: 15/308,315

(22) PCT Filed: Dec. 16, 2014

(86) PCT No.: PCT/US2014/070593
§ 371 (c)(1),
(2) Date: Nov. 1, 2016

(87) PCT Pub. No.: WO2016/099457
PCT Pub. Date: Jun. 23, 2016

(65) Prior Publication Data

US 2017/0081938 A1 Mar. 23, 2017

(51) Int. Cl.
*E21B 23/06* (2006.01)
*E21B 47/00* (2012.01)
(Continued)

(52) U.S. Cl.
CPC ..... *E21B 23/06* (2013.01); *E21B 33/128* (2013.01); *E21B 33/1275* (2013.01); *E21B 47/0006* (2013.01); *E21B 47/06* (2013.01)

(58) Field of Classification Search
CPC ..... E21B 23/06
See application file for complete search history.

(56) References Cited

U.S. PATENT DOCUMENTS 3,866,690 A 2/1975 Lance et al.
5,228,519 A 7/1993 Coronado et al.
(Continued)

FOREIGN PATENT DOCUMENTS

WO 2015/023300 A1 2/2015

OTHER PUBLICATIONS

International Search Report and Written Opinion issued in related PCT Application No. PCT/US2014/070593 dated Sep. 8, 2015, 13 pages.

(Continued)

*Primary Examiner* — Robert E Fuller
(74) *Attorney, Agent, or Firm* — Benjamin Fite; Baker Botts L.L.P.

(57) ABSTRACT

A setting tool for setting a packer in a wellbore includes a housing defining a hydraulic chamber, a piston disposed in the chamber, a pump coupled to the chamber via a flowline, and a setting sleeve directly or indirectly coupled to the piston. The pump may be used to pump pressurized fluid into the hydraulic chamber for pushing the piston in a direction, and the setting sleeve may be used to apply a compressive force to a packer element of the packer in response to the piston being pushed in that direction. The setting tool may include a sensor used to collect a measurement relating to a force on the workstring, in addition to a controller designed to receive a signal from the sensor and to provide a control signal to the pump based on the sensor signal.

20 Claims, 7 Drawing Sheets

(51) Int. Cl.

| | |
|---|---|
| ***E21B 33/127*** | (2006.01) |
| ***E21B 33/128*** | (2006.01) |
| ***E21B 47/06*** | (2012.01) |

(56) References Cited

U.S. PATENT DOCUMENTS

| | | | | |
|---|---|---|---|---|
| 5,826,652 | A | 10/1998 | Tapp | |
| 6,341,654 | B1 | 1/2002 | Wilson et al. | |
| 7,779,908 | B2 | 8/2010 | Eriksson et al. | |
| 2004/0112597 | A1 | 6/2004 | Hamid et al. | |
| 2005/0028972 | A1 | 2/2005 | Wilson et al. | |
| 2010/0200244 | A1* | 8/2010 | Purkis ..... | E21B 34/066 166/373 |
| 2013/0014959 | A1 | 1/2013 | Tips et al. | |
| 2013/0056200 | A1 | 3/2013 | Martinez et al. | |
| 2017/0284168 | A1* | 10/2017 | Zevenbergen ..... | E21B 23/06 |

OTHER PUBLICATIONS

International Preliminary Report on Patentability issued in related Application No. PCT/US2014/070593, dated Jun. 29, 2017 (10 pages).

* cited by examiner

PACKER SETTING TOOL WITH INTERNAL PUMP

CROSS-REFERENCE TO RELATED APPLICATION

The present application is a U.S. National Stage Application of International Application No. PCT/US2014/070593 filed Dec. 16, 2014, which is incorporated herein by reference in its entirety for all purposes.

TECHNICAL FIELD

The present disclosure relates generally to well completion operations and, more particularly, to a pump-operated packer setting tool.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, or remedial activities. It is common practice in completing oil and gas wells to set a string of pipe, known as casing, in the well to isolate the various formations penetrated by the well from the wellbore. The casing is typically perforated adjacent the formation to provide flowpaths for the valuable fluids from the formation to the wellbore. If production tubing is simply lowered into the wellbore and fluids are allowed to flow directly from the formation, into the wellbore, and through the production tubing to the earth's surface, fine sand from the formation could be swept along with the fluids and carried to the surface by the fluids.

Gravel pack operations are typically performed in subterranean wells to prevent fine particles of sand or other debris from being produced along with valuable fluids extracted from the formation. Conventional gravel pack operations prevent the fine sand from being swept into the production tubing by installing a sand screen in an open wellbore. Gravel pack systems generally include a packer that is set to seal and anchor the gravel pack system and production tubing in place within the perforated wellbore. Currently, workstring tubing is plugged by landing a setting ball in a ball seat below the packer, and then pressure is applied to the tubing to set the packer. Unfortunately, the setting ball can become lost in the workstring tubing, resulting in a loss of productive time as a new ball is dropped through the tubing. In addition, raising the tubing after setting the packer while the tubing is plugged can lead to a pressure differential between components above and below the packer. This pressure differential can pull parts of the formation inward toward the wellbore, leading to bridging off or collapse of the formation around the screen of the gravel pack system.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
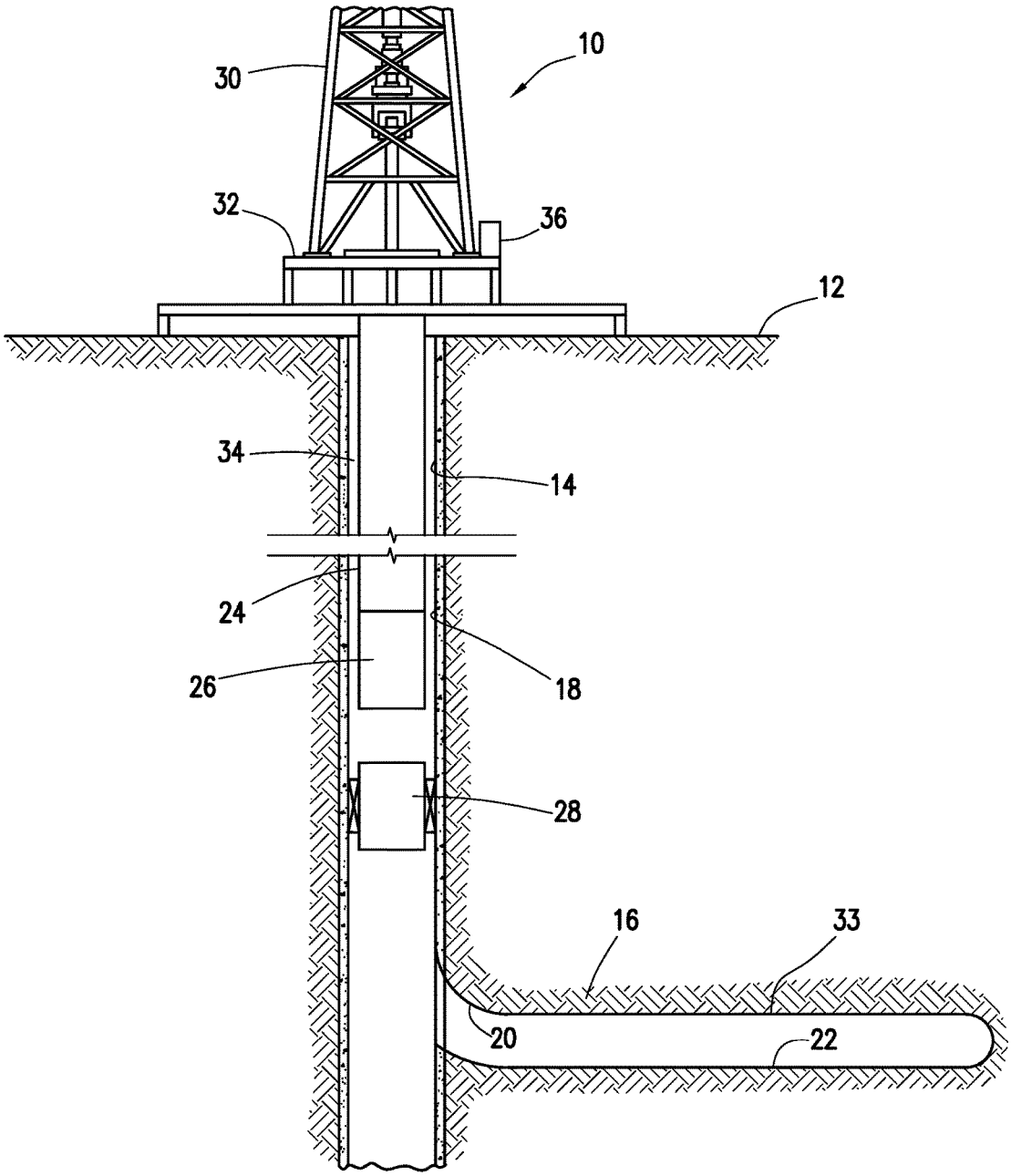
FIG. 1 is a schematic partial cross-sectional view of a wellbore completion system in a wellbore environment, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a setting tool used for setting a packer in a wellbore. The disclosed setting tool may include a pump that is battery powered to provide pressurized fluid to a piston to set the packer. In some embodiments, the setting tool may include a reservoir of hydraulic fluid for the pump to pressurize toward the piston, while in other embodiments, the pump of the setting tool may filter and pressurize wellbore fluids to actuate the piston. Some embodiments of the setting tool may include a controller communicatively coupled to the pump and to one or more sensors disposed in the setting tool. The sensors may provide feedback relating to surface-initiated loads or torques applied to the setting tool, and the controller may provide control signals to the pump based on the sensor feedback. For example, the controller may initiate a setting procedure of the pump upon detecting a pre-determined amount, or sequence, of tension/compression or torque on the setting tool. The setting tool may include a pressure sensor designed to monitor the pressure of hydraulic fluid applied to the piston, and this measured pressure may provide a confirmation to the customer that the packer has been properly set via the setting tool.

For purposes of this disclosure, the term "controller" may refer to any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, a controller may be a personal computer, a network storage device, or any other suitable device and may vary in size, shape, performance, functionality, and price.

The disclosed controller may include one or more processing components. The processing components may include a central processing unit (CPU) or hardware or software control logic. The controller may include multiple distributed processors disposed at different locations (e.g., in a downhole setting tool or at the surface). These processing components may be designed to receive various inputs from downhole sensors and/or from an operator interface at the surface.

In addition, the controller may include one or more memory or storage components such as, for example, random access memory (RAM), ROM, Flash memory, and/or other types of nonvolatile memory. The processing components may be operably coupled to the memory component or storage component to execute instructions for carrying out the presently disclosed pump operating techniques. These instructions may be encoded in programs that may be executed by the processing components determine and output control signals for operating the pump to set the packer. These codes may be stored in any suitable article of manufacture that includes at least one tangible non-transitory, computer-readable medium that at least collectively stores these instructions or routines, such as the memory component or the storage component.

For example, the controller may include an initiation sequence for the pump that is programmed into memory (e.g., Flash memory) and accessible by the processor component. The setting sequence may be programmed into Flash memory for the pump to follow. In some embodiments, data collected from downhole sensors (e.g., pressure transducers and strain gauges) may be recorded in memory (e.g., Flash memory) for later downloading via an external data port, Bluetooth connection, or Wi-Fi connection.

The disclosed setting tool may provide a reliable packer setting method for gravel pack packers, among other types of packers. The setting tool may save customers time by setting the packer via a downhole pump initiated based on sensor measurements, as opposed to waiting for a ball dropped in the workstring tubular flowline to land. Indeed, the disclosed setting tool may function to set a packer without utilizing a ball at all. As such, it may be possible to set the packer without plugging a central flow path through the tubular string and setting tool using a ball, a plug, a wireline valve, or a ball valve. Thus, the packer may be set without altering a pressure in the tubing coupled to the setting tool, thereby maintaining pressure to keep the wellbore from collapsing during the packer setting procedure.

Referring now to FIG. 1, an example of a wellbore operating environment is shown. As depicted, the operating environment includes a drilling rig 10 that is positioned on the earth's surface 12 and extends over and around a wellbore 14 that penetrates a subterranean formation 16 for the purpose of recovering hydrocarbons. The wellbore 14 may be drilled into the subterranean formation 16 using any suitable drilling technique. The wellbore 14 extends substantially vertically away from the earth's surface 12 over a vertical wellbore portion 18, deviates from vertical relative to the earth's surface 12 over a deviated wellbore portion 20, and transitions to a horizontal wellbore portion 22. In other operating environments, all or portions of a wellbore may be vertical, deviated at any suitable angle, horizontal, and/or curved. The wellbore 14 may be a new wellbore, an existing wellbore, a straight wellbore, an extended reach wellbore, a sidetracked wellbore, a multi-lateral wellbore, or any other type of wellbore for drilling and completing one or more production zones. Further the wellbore 14 may be used for both producing wells and injection wells. In some embodiments, the wellbore 14 may be used for purposes other than or in addition to hydrocarbon production, such as uses related to geothermal energy.

A wellbore tubular string 24 including a packer setting tool 26 may be lowered into the subterranean formation 16 for a variety of workover or treatment procedures throughout the life of the wellbore. For example, the packer setting tool 26 may generally be configured to set a packer 28 within the wellbore 14 to isolate a zone of the wellbore 14 beneath the packer 28 for gravel packing or other operations. The packer 28 may be a permanent packer designed to remain at the set position in the wellbore 14, or the packer 28 may be a retrievable packer that can later be retrieved by the same or a different setting tool 26. In some embodiments, the packer 28 may be employed as part of a sand control or gravel pack completion, in order to position the sand screen at a desired depth within the wellbore 14.

The embodiment shown in FIG. 1 illustrates the wellbore tubular 24 in the form of a tubing string being lowered into the subterranean formation. It should be understood that the wellbore tubular 24 having a packer setting tool 26 is equally applicable to any type of wellbore tubular being inserted into a wellbore, including as non-limiting examples drill pipe, production tubing, rod strings, and/or coiled tubing. The packer setting tool 26 may also be used to set various other tools such as hangers, plugs, annular safety valves, and any other component using a compression force for actuation.

The drilling rig 10 may include a derrick 30 with a rig floor 32 through which the wellbore tubular 24 extends downward from the drilling rig 10 into the wellbore 14. The drilling rig 10 includes a motor driven winch and other associated equipment for extending the wellbore tubular 24 into the wellbore 14 to position the wellbore tubular 24 at a selected depth. In the illustrated embodiment, the operating environment may refer to a stationary drilling rig 10 for lowering and setting the wellbore tubular 24 and the packer setting tool 26 within a land-based wellbore 14. However, in other embodiments, workover rigs, wellbore servicing units (such as coiled tubing units), and the like may be used to lower the wellbore tubular 24 having the packer setting tool 26 into a wellbore. It should be understood that a wellbore tubular 24 including the packer setting tool 26 may also be used in other operational environments, such as within an offshore wellbore operational environment.

In further operating environments, a vertical, deviated, or horizontal wellbore portion may be cased and cemented and/or portions of the wellbore may be uncased. For example, an uncased section 33 may include a section of the wellbore 14 that is ready to be cased with wellbore tubular 24. In some embodiments, the packer setting tool 26 may be used on production tubing in a cased or uncased wellbore. In addition, some embodiments of the packer setting tool 26 may be used in an underreamed section of the wellbore 14. As used herein, underreaming refers to the enlargement of an existing wellbore below an existing section, which may be cased in some embodiments. An underreamed section may have a larger diameter than a section above the underreamed section. Thus, the wellbore tubular passing down through the wellbore may pass through a smaller diameter passage followed by a larger diameter passage.

Regardless of the type of operational environment in which the packer setting tool 26 is used, the packer setting tool 26 may be able to set the packer 28 without closing off an internal flowline from the wellbore tubular 24 to an annulus 34 of the wellbore 14 below the packer 28. To accomplish this, the setting tool 26 may be equipped with an electric pump, as described in detail below, to set the packer 28. The pump may be operated based on signals received from sensors present in the setting tool 26. The sensors may be designed to sense properties (e.g., temperature, pressure, strain, torque) relating to the workstring coupled to the setting tool 26. The setting tool 26 may operate the pump to set the packer 28 based on the detected strain, torque, pressure, and/or temperature measured along the downhole setting tool 26. In some embodiments, these detected sensor measurements may be transmitted to a surface level control system 36 of the drilling rig 10. In some embodiments, the surface level control system 36 may provide control signals to the setting tool 26 to operate the pump as desired.

Figure 2:
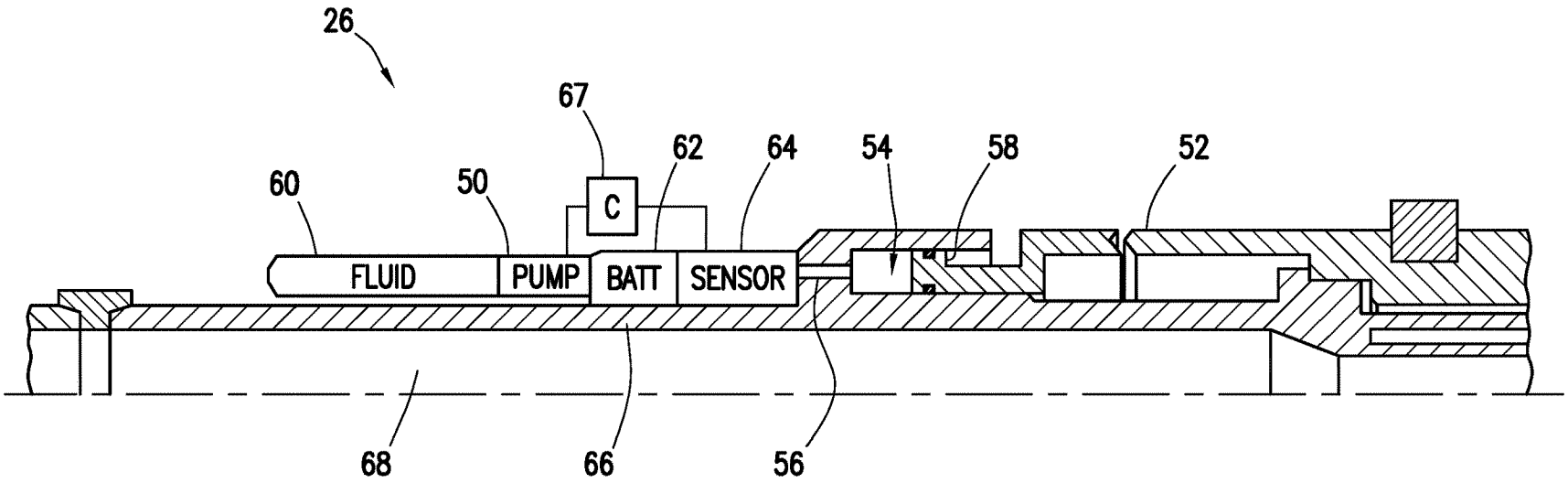
FIG. 2 is a schematic view of certain components of a packer setting tool used in the wellbore completion system of FIG. 1, in accordance with an embodiment of the present disclosure.

FIG. 2 schematically represents a more detailed embodiment of the setting tool 26 that may be used to set the packer 28. In the illustrated embodiment, the setting tool 26 may include an electric pump 50 that is used to pressurize fluid for applying a compression force to a setting sleeve 52 to set the packer 28. More specifically, the setting tool 26 may include the pump 50, a hydraulic chamber 54 coupled to the pump 50 via flowpath 56, and a hydraulic piston 58 disposed within the chamber 54.

As illustrated, the piston 58 may extend out of the chamber 54 and be coupled to the setting sleeve 52. As the pump 50 pushes hydraulic fluid into the chamber 54, the fluid may force the piston 58 outward to apply a force to the setting sleeve 52. The piston 58 may include seals formed thereon in order to maintain the hydraulic fluid within the chamber 54 as the piston 58 is forced outward. The setting sleeve 52 may be designed to transfer the compressive force to the slips and packer element of the packer 28, thereby forcing the packer element and slips to extend outward and grip the wellbore 14. After the setting tool 26 sets the packer in this manner, the setting tool 26 may release from the packer and the pump 50 may operate in a reverse direction to return the piston 58 to its run-in position.

In some embodiments, the pump 50 may use filtered well fluids to pressurize the setting tool 26. However, in the illustrated embodiment, the pump 50 may utilize a reservoir 60 of fluid stored in the setting tool 26 itself, and may direct the fluid from the reservoir 60 toward the chamber 54 and the hydraulic piston 58 to provide the compression force to set the packer 28. By using a separate reservoir in this manner, the setting tool 26 may ensure that the pump 50 only pressurizes clean fluid. The electric pump 50 may be powered by a battery pack 62 disposed in the setting tool 26, as illustrated. However, it should be noted that other power sources may be used to power the pump 50 in other embodiments.

In some embodiments, the pump 50 may be operated in response to a sensor 64 disposed in the setting tool 26. The illustrated "sensor" 64 may refer to any number of sensors designed to measure strains indicative of tension/compression on components of the setting tool 26, such as an inner mandrel 66 of the setting tool 26. For example, the sensor 64 may include one or more strain gauges used to read a tension or compression applied to the wellbore tubular and the mandrel 66. In addition to or in lieu of strain gauges, the sensor 64 may include any number of sensors designed to measure downhole temperatures, torques, hydrostatic pressure, hydraulic pressure on the piston 58, piston displacement within the chamber 54, magnetic fields, materials, and/or radioactivity downhole.

As described in detail below, a controller 67 may operate the pump 50 based on these sensor measurements and according to a predetermined setting routine to set the packer 28 as desired. Thus, if an operator wishes to activate the pump 50 to set the packer 28 or initiate a step of a pre-programmed packer setting pump sequence, the operator may put weight down on a component of the setting tool 26 or lift a portion of the setting tool 26 so that the sensor detects the appropriate tension or compression. Thus, the setting tool 26 may include an open-bore pump-operated device that can be activated remotely. In some embodiments, the controller 67 may be programmed to operate the pump 50 in a certain manner based on a combination of tubing set down and pick up motions that are detected via the sensors 64 to initiate the packer setting procedure. Thus, the setting tool 26 may be programmed to start or stop a pump operation based on movement of the workstring (e.g., wellbore tubing).

The illustrated battery powered setting tool 26 may be used to set the packer 28 without utilizing a setting ball dropped down a central flow path 68 through the setting tool 26 and the wellbore tubular string. Since the setting tool 26 is designed to operate without using a dropped ball, a plug, a wireline valve, or a ball valve, the setting tool does not plug the central flowpath 68 while setting the packer. Thus, the setting tool 26 may enable pressure maintenance through the wellbore while setting the packer, without having to use a complicated flow diverting setup. Indeed, the setting tool 26 may function to set the packer while still pumping fluid down the workstring tubing coupled to an upper portion of the central flowpath 68, and through the central flowpath 68 of the setting tool 26 toward a portion of the wellbore below the packer. This may maintain a pressure through the wellbore tubular (workstring) that is the same as the pressure in the annulus of the wellbore below the packer. Any movement of the gravel pack system at this point while setting the packer will not lead to undesirable swabbing of the formation.

As noted above, the disclosed pump-operated setting tool 26 may eliminate the ball that is used to activate existing setting tools. This may reduce the number of balls that do not seal properly in the tubular string or setting tool 26, thereby increasing the reliability of the system operation. In addition, the absence of a dropped ball may simplify the setting tool 26, since no ball seat and corresponding sleeves are needed to provide pressurized fluid to the chamber 54. Still further, the setting tool 26 may eliminate the rig time normally spent waiting for a dropped ball to land in a ball seat of the setting tool, since the disclosed setting tool 26 is capable of pressurizing fluid downhole without diverting a flow of fluid from the central flowpath 68. The presently disclosed setting tool 26 may be particularly suitable in applications where it would be difficult for a setting ball released from the surface to reach the setting tool 26. Furthermore, the disclosed system may eliminate the presence of an additional setting ball in the flow stream during subsequent drilling/completion operations.

Figure 3:
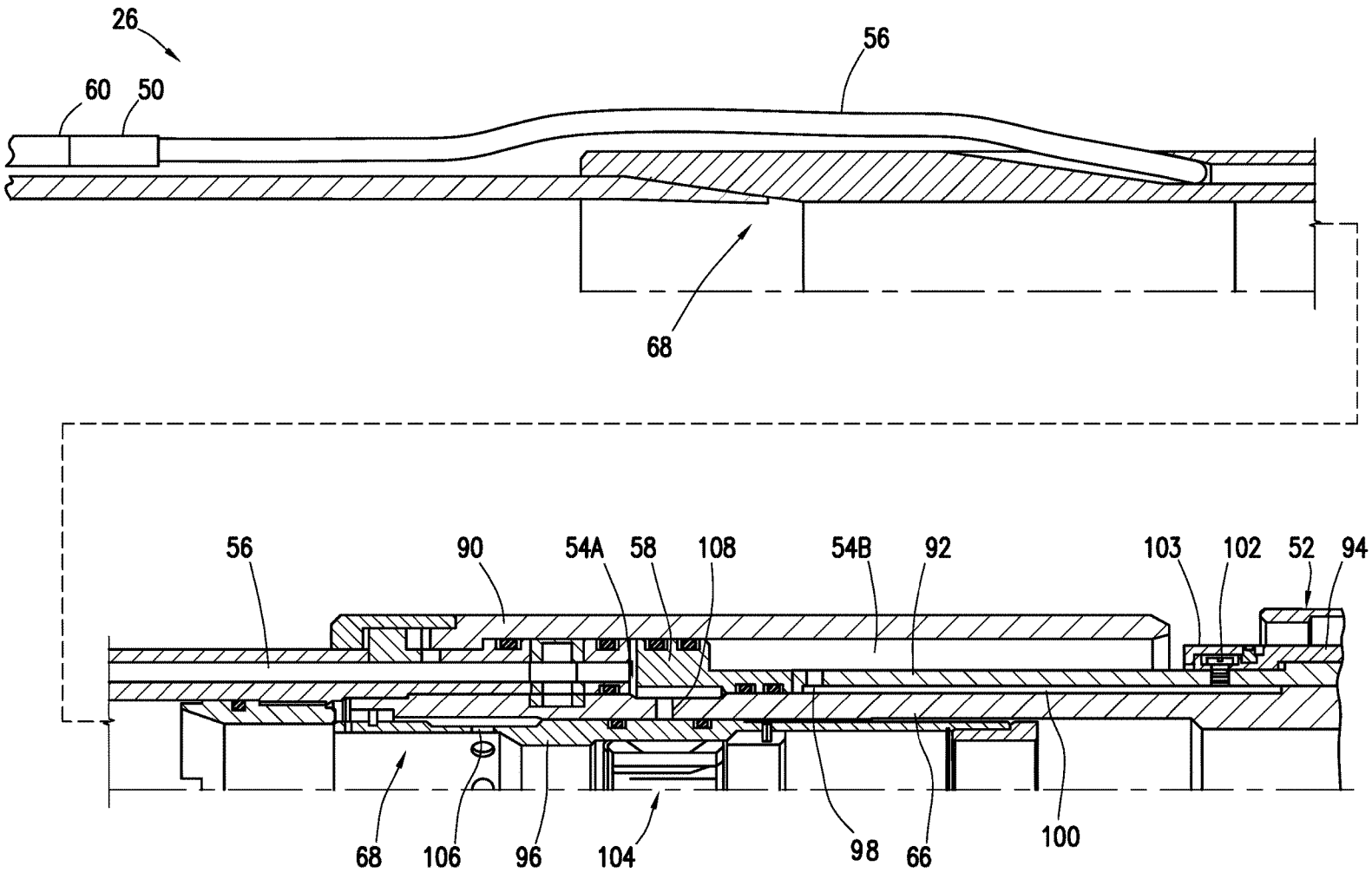
FIG. 3 is a schematic partial cross sectional view of a packer setting tool, in accordance with an embodiment of the present disclosure.

Having now discussed the general arrangement of components that may be present within the setting tool 26, a more detailed description of some embodiments of the setting tool 26 will be provided. FIG. 3, for example, illustrates one embodiment of the setting tool 26 that utilizes a pump 50 to activate the system to set the packer 28, as described above. As before, the pump 50 may pressurize and direct either filtered well fluids or hydraulic fluid from a reservoir 60 to the chamber 54 to move a piston 58 axially through the chamber 54. The illustrated embodiment shows the reservoir 60 and pump 50 being located a distance from the chamber 54 and coupled to the chamber 54 via the flow path 56. The flow path 56 may be a control line, as illustrated, or a drilled path through the inner mandrel 66.

In certain embodiments, the setting tool 26 may include a number of sleeves, mandrels, driving components, and/or housing components that form an interface between the piston 58, the chamber 54, the setting sleeve 52, and the central flowpath 68. For example, the illustrated setting tool 26 may include, among other things, a chamber housing 90 defining the chamber 54, a driving mechanism 92, a centralizing member 94, and an isolation sleeve 96. The chamber housing 90 may define the outer circumferential boundary of the annular chamber 54 through which the piston 58 may be pushed via pressurized fluid. As illustrated, the chamber housing 90 may be open at one end so that one side of the chamber 54B is open to fluid around the housing 90 while the other side of the chamber 54A is open to the flow path 56. The piston 58 may be equipped with seals that enable the piston 58 to move axially through the chamber 54 with respect to both the chamber housing 90 and the inner mandrel 66. Although these parts are separate in the illustrated embodiment, the chamber housing 90 may be integral with the inner mandrel 66 in other embodiments such that the flow path 56 and the chamber 54 are formed within the integral component.

The driving mechanism 92 may be used to transfer axial movement from the piston 58 to the setting sleeve 52. In some embodiments, the driving mechanism 92 may be coupled to the piston 58, while in other embodiments the two may be separate components that are disposed adjacent one another to transfer movement. The illustrated driving mechanism 92 may include a port 98 formed therethrough. This port 98 may facilitate a flow of wellbore fluid out of a chamber 100 formed between the driving mechanism 92 and the inner mandrel 66 as the chamber 100 becomes smaller due to axial movement of the driving mechanism 92 relative to the inner mandrel 66.

As illustrated, the driving mechanism 92 may be coupled to the centralizing member 94 via a shear screw 102 and a shoulder component 103. Thus, the driving mechanism 92 may transfer axial movement of the piston 58 relative to the chamber 54 into axial movement of the centralizing member 94 into a space between the setting sleeve 52 and the inner mandrel 66. As the centralizer member 94 is driven further through the setting tool 26, the centralizing member 94 may maintain the driving mechanism and other moving components in a coaxial position within the setting tool 26 and the packer. At some point during this movement, the centralizing member 94 may contact a shoulder of the setting sleeve 52, in order to transfer axial movement and force through the setting sleeve 52. This axial movement of the setting sleeve 52 may provide a compressive force to a packer element in order to set the packer as set forth above.

At some point, the setting sleeve 52 may reach an axial position and/or compressive force that fully sets the packer. This maximum setting force may cause the driving mechanism 92 to shear the shear screw 102, thereby releasing the driving mechanism 92 from the centralizer member 94 and signaling to an operator that the packer is set. In this way, the shear screw 102 acts as a releasing mechanism for the setting tool 26. Although the illustrated setting tool 26 utilizes a releasing mechanism that is activated via a shearing component (e.g., shear screw 102), other embodiments of the setting tool 26 may be rotated out of contact with the packer once the packer is set. In still other embodiments, the setting tool 26 may rely on an annular pressure release to disconnect the setting tool 26 from the packer. Once the setting tool 26 is released from the packer, the setting tool 26 may be brought up out of the wellbore, so that additional completion equipment may be lowered into the wellbore.

The isolation sleeve 96 may be disposed adjacent the inner mandrel 66 and extend radially into the central flowpath 68. The isolation sleeve 96 may be used to close off the central flowpath 68 through the setting tool 26 after the setting tool 26 is released from the packer. Once the setting tool 26 is released from the packer via one of the above described releasing mechanisms, fluid pressure may be balanced between the tubular string and the annulus below the packer without needing to maintain an open central flow line through the setting tool 26. Thus, the central flowline 68 may be closed off by pumping a ball down the tubular string and through the central flowline 68 until the ball catches in a ball seat 104 formed into the isolation sleeve 96.

In some embodiments, the isolation sleeve 96 may include a port 106 formed therethrough. After a ball is dropped into the ball seat 104 of the isolation sleeve 96, pressure may be applied from the surface through the central flowpath 68 to push the ball against the ball seat 104. The applied pressure may shear the isolation sleeve 96 from the its connection to the inner mandrel 66, thereby causing the isolation sleeve 96 to shift downward relative to the inner mandrel 66 until the port 106 of the isolation sleeve 96 generally aligns with a return port 108 through the inner mandrel 66. When these ports 106 and 108 are aligned, the return port 108 may be open, thereby forming a flowpath between the pump side of the chamber 54A and the central flowpath 68.

After setting the packer via the setting tool 26, picking up the tool, and exposing the return port 108 as described above, pressure through the annulus above the packer may be used to close off a path through a workstring washdown component of the gravel pack system. Since the return port 108 is exposed in this instance, the pressurized fluid from the pump side of the chamber 54A may exit the chamber 54 through the return port, thereby returning the piston 58 to its initial stroke position. In such embodiments, it may be desirable to replenish the supply of fluid for the pump 50 to pressurize the next time the setting tool 26 is used to set a packer. Accordingly, the setting tool 26 may include a closing mechanism that features a check valve for filling the backside volume of the pump 50 when the setting tool 26 is again run into a wellbore.

In other embodiments, the isolation sleeve 96 may be used as a back-up setting method in the event that the pump 50 does not function as desired to set the packer. In this instance, a ball may be dropped from the surface to land in the ball seat 104 of the isolation sleeve 96, thereby shifting the sleeve to expose the ports 106 and 108. Once the sleeve 96 is shifted, pressurized fluid may be pumped from the surface through the ports 106 and 108 and into the chamber 54 to push the piston 58 toward the setting sleeve 52 to set the packer. Thus, the isolation sleeve 96 may provide a redundant system for setting the packer via the setting tool 26, in case the pump 50 does not perform as expected. In other embodiments, the backup setting components may include a ball seat used with a burst disk (instead of the isolation sleeve 96 with the port 106) to direct the pressurized fluid from the central flowpath 68 into the chamber 54.

Some embodiments of the setting tool 26 may utilize a reversible pump 50 to provide pressurized fluid to the chamber 54 for setting the packer. Once the setting tool 26 sets the packer using such a reversible pump 50, the pump 50 may be operated in reverse to pump the fluid from the pump side of the chamber 54A back into the reservoir 60. Thus, the pump 50 may move the setting piston 58 back into its running position, or farther past its running position. In doing so, the pump 50 may return the setting tool 26 to its original operating position while blocking the return port 108 and other ports through the setting tool 26. By using the reversible pump 50, there may be no reason to align the ports 106 and 108 via the tubing pressure applied to the sleeve 96. Ports that may have been used for contingency setting of the packer via tubing pressure may be blocked by the pump 50 moving the piston 58 back past its original set position. Blocking these ports may increase the sealing integrity throughout the setting tool 26.

Additionally, the reversible pump 50 may be used to achieve other activations of the setting tool 26. For example, after pumping fluid through the chamber 54 to provide an optimum packer set pressure, the pump 50 may reverse the flow of fluid to de-activate a locking mechanism within the setting tool 26. After this, the pump 50 may pump downward again to apply pressure for releasing the setting tool 26 from the packer, as described above. In some embodiments, the pump 50 may be configured to perform multiple pressure cycles to achieve multiple different activations and de-activations of components within the setting tool 26 or coupled to the setting tool 26. In addition, the reversible pump 50 may be used to position the piston 58 in a desirable axial position within the chamber 54 to minimize effects of pressure in the sides of the chamber during subsequent operations.

Figure 4:
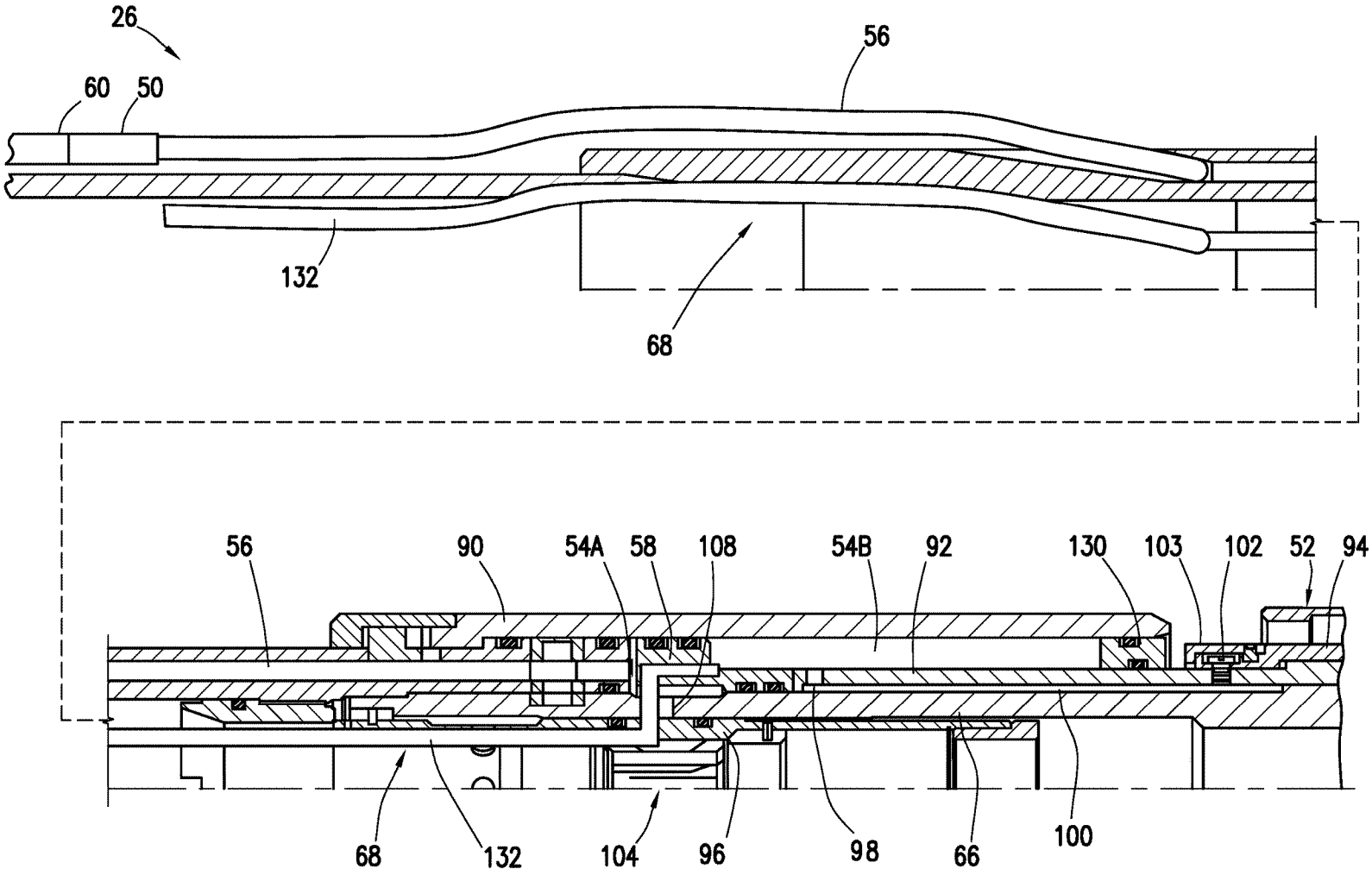
FIG. 4 is a schematic partial cross sectional view of a packer setting tool, in accordance with an embodiment of the present disclosure.

FIG. 4 illustrates another embodiment of the setting tool 26 that may utilize the pump 50 to set a packer. The illustrated setting tool 26 is generally similar to the setting tool 26 illustrated in FIG. 3, but instead of the chamber 54 being open at one end 54B, both portions of the chamber 54A and 54B are closed. For example, as illustrated, a seal 130 may be disposed in the side of the chamber 54B opposite the pump side of the chamber 54A. The setting tool 26 may also include a recirculation tube 132 (return fluid flow path) open to the side of the chamber 54B, thereby allowing the fluid in this side of the chamber 54B to be removed therefrom in response to movement of the piston 58. In the illustrated embodiment, the return fluid flow path is a control line, but in other embodiments the return fluid flow path may include a drilled path through the inner mandrel 66. Although not shown, the recirculation tube 132 may be coupled at an opposite end to the reservoir 60 or a similar back chamber of the pump 50. From here, the recirculated fluid may be pressurized and used as the setting volume pumped into the chamber 54A. Thus, the second part of the chamber 54B may function as an extension of the reservoir 60 that provides the hydraulic fluid for the pump 50.

As illustrated, the recirculation tube 132 may extend through the piston 58 to communicate with the lower side of the chamber 54B. This may enable the recirculation tube 132 to transfer all available fluid from the chamber 54B to the reservoir 60 or pump 50 as the piston 58 is fully stroked through the chamber 54. In other embodiments, the recirculation tube 132 may include a line around the outside of the chamber 54 to provide the return flow path. By sealing the sides of the chamber 54 as described herein, the illustrated embodiment may protect the pump 50 and other portions of the setting tool 26 from coming into contact with corrosive fluids. In addition, by maintaining the hydraulic pumping fluid in this closed circuit and using a reversible pump 50, the setting tool 26 may utilize a relatively clean fluid for all functions performed by the pump 50, thereby increasing the life of the pump 50.

As mentioned above with reference to FIG. 2, the setting tool 26 may include a controller 67 that is programmed to operate the pump 50 according to a predefined setting routine. The setting routine may rely on feedback from the one or more sensors 64 to initiate certain portions of the routine. As an example of one such setting routine, FIGS. 5 and 6 illustrate plots 150 and 152, respectively, showing a strain gauge reading indicative of tension/compression on a setting tool component and a corresponding pressurization of the piston during the setting routine.

Figure 5:
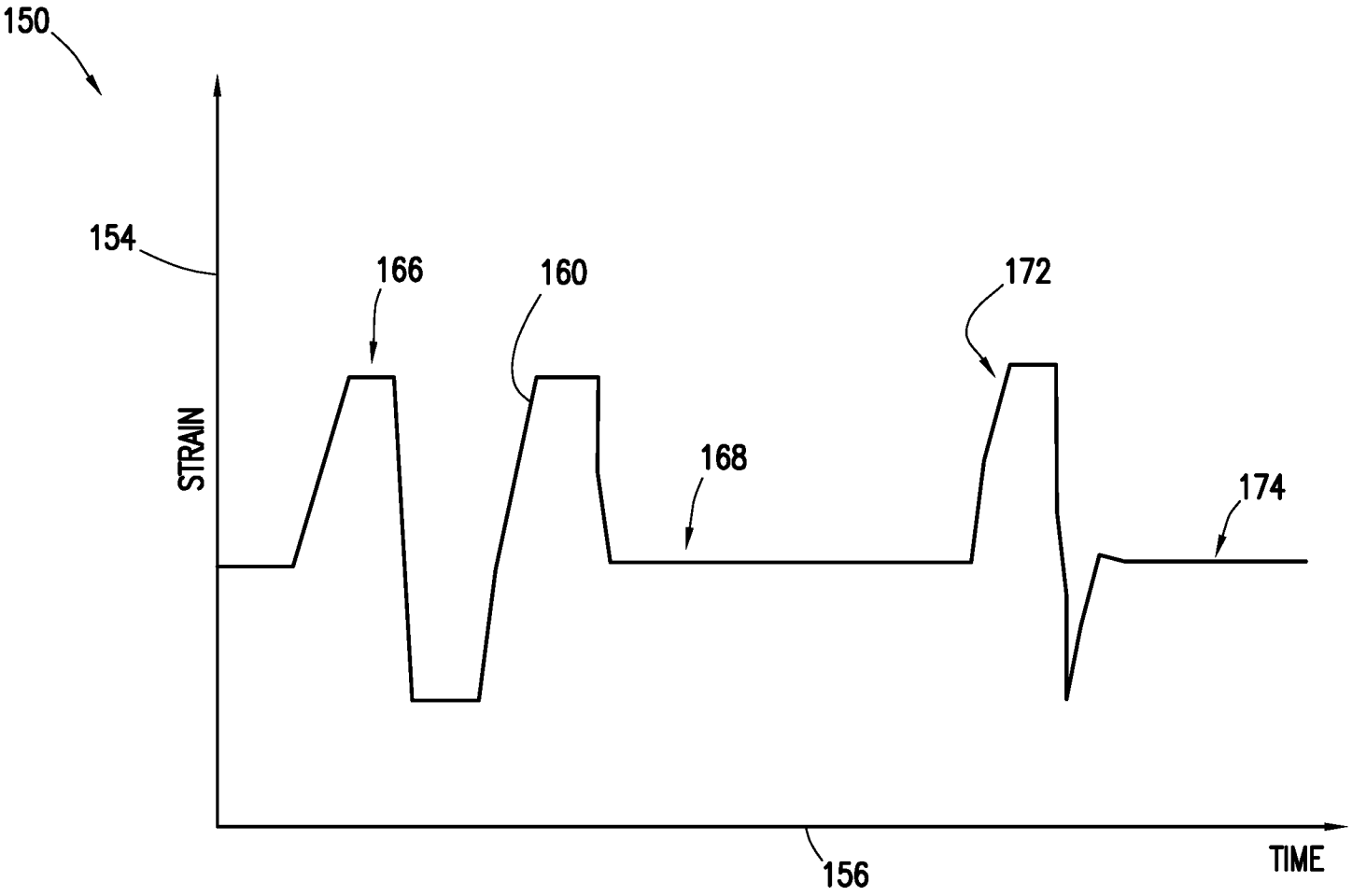
FIG. 5 is a plot illustrating a strain measurement taken with respect to time via sensors in the packer setting tool of FIG. 2, in accordance with an embodiment of the present disclosure.

FIG. 5 illustrates the plot 150 of strain 154, as measured via a strain gauge, on a structural component of the setting tool (e.g., mandrel 66 of FIG. 2) with respect to time 156. FIG. 6 illustrates the plot 152 showing a pressure 158 on the piston 58 of FIG. 2 with respect to time 156. The plot 150 of FIG. 5 shows a trend line 160 representing the strain measurement feedback used to initiate certain steps in the packer setting procedure. The plot 152 of FIG. 6 shows a trend line 162 representing the corresponding pressure being applied by the pump to the piston in response to the detected strain. Thus, FIG. 5 represents the strain gauge feedback while FIG. 6 represents the pressurization of the pump being controlled in response to the sensor feedback.

Figure 6:
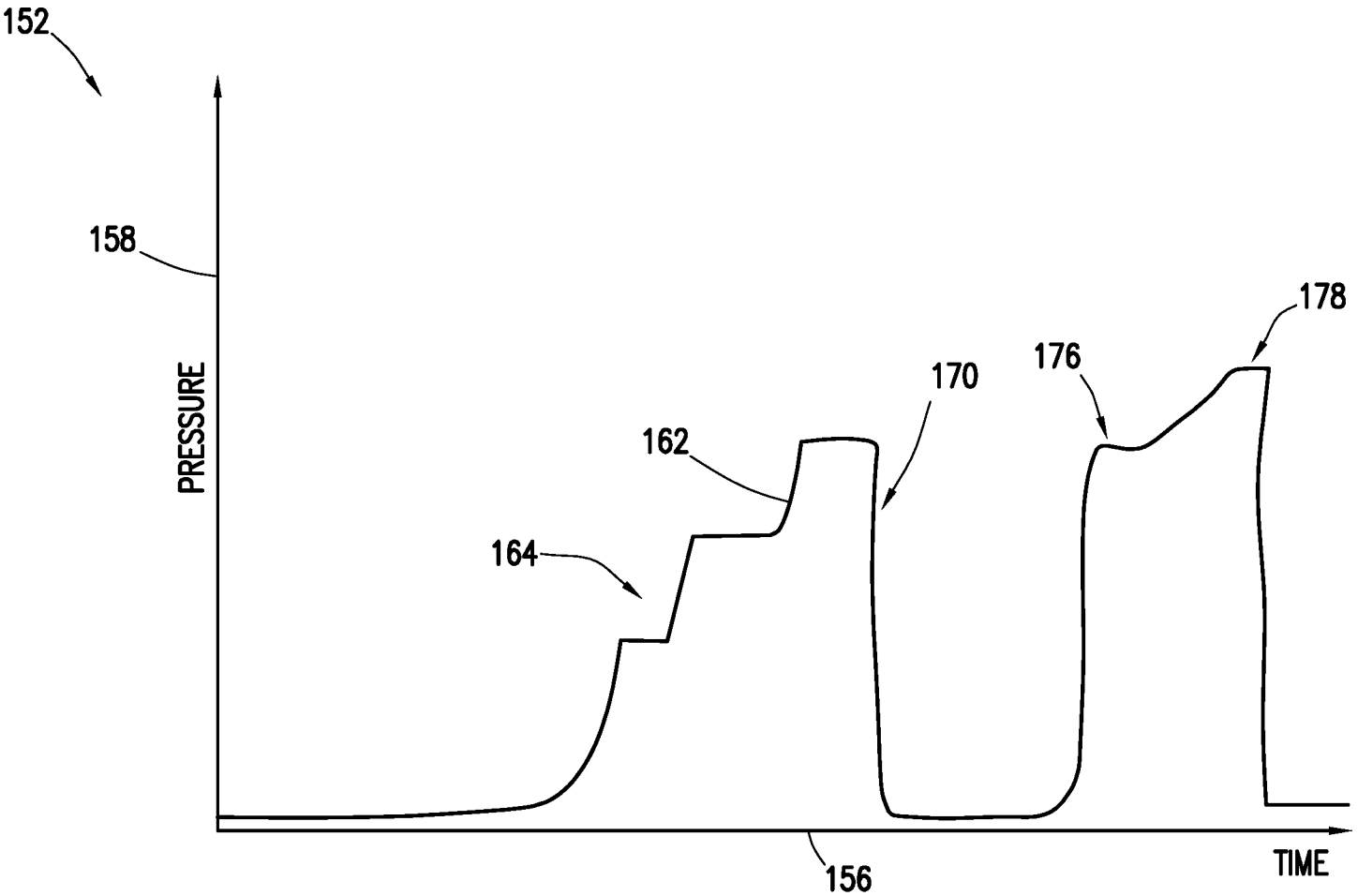
FIG. 6 is a plot illustrating a pressure measurement taken with respect to time via sensors in the packer setting tool of FIG. 2, in accordance with an embodiment of the present disclosure.

As shown in FIGS. 5 and 6, during a predefined packer setting procedure, the pump may build pressure inside the piston chamber (pressure increase 164) in response to a detected tension/compression applied to the setting tool from the surface via the tubing. For example, in the illustrated embodiment, a detected sequence 166 of tension/compression as measured by the strain gauge may trigger the pump's initiation of this pressure increase 164. In the illustrated embodiment, the sequence 166 may include an application of increased tension, followed by a compression force, followed by another increase in tension. This may be accomplished by a drilling rig picking up the tubular string to increase tension and pushing down on the tubular string to increase compression. After the pumping sequence for setting the packer is initiated, the strain reading indicates that the weight on the setting tool may be slacked off to return the tool to a neutral strain measurement 168.

It should be noted that the illustrated sequence 166 of FIG. 5 is an example of one sequence that may be used, but other embodiments of the setting tool controller may be programmed to respond to other tension/compression sequences. For example, in some embodiments, the controller may send a control signal to the pump to initiate the setting procedure in response to a detected amount of tension or compression applied to the setting tool exceeding a threshold value. In other embodiments, the controller may send the initiation signal in response to a detected tension or compression level exceeding a threshold number of cycles. In further embodiments, the controller may send the initiation signal in response to the detected tension or compression level exceeding a threshold number of cycles within a set time period.

After a processor of the controller reads the set down and pick up loads of the sequence 166 within a determined amount of time, the setting program is initiated. In response to this trigger, the pump may transfer fluid from the reservoir to the piston chamber according to a pre-programmed setting routine. In some embodiments, the pressure increase 164 may be a stepped increase in pressure, as illustrated. That is, the pressure may be increased and held, then increased and held, multiple times in order to properly set the packer. In other embodiments, the pressure increase 164 may be a single smooth increase in pressure. This pressure increase 164 may push the setting sleeve far enough to result in setting the slips and the packer element of the packer against the wellbore.

In some embodiments, the packer setting procedure may end at this point, with the packer being fully set after the initial pressure increase 164. However, in other embodiments, it may be desirable to stop the pumping via the setting tool at a prescribed pressure so that another operation can be performed via the setting tool before fully setting the packer. Such operations may include, for example, a push and pull test (as described below), a torque test, a pressure test, or setting/activating other devices disposed along the tubing string via the setting tool controller or some other controller in communication therewith.

There may be one or more stopping points along the stroke length of the piston where the pump may stop increasing/applying pressure to the piston to enable other functions to be performed, or to hold off on increasing the pressure for a certain amount of time. For example, these stopping points within the setting process may correspond to a point where the slips are set, a point where the packer element is set, a point where the setting tool locking mechanism is released to allow the packer to fully set, a point where a minimum setting force is applied, or a point where a maximum setting force is applied. Other stopping points may be desirable in certain embodiments.

Pump displacement sensor feedback may be utilized to stop and re-start the piston at these various stopping points along the stroke length. This pump displacement feedback may be determined via a pressure sensor used to detect the pressure on the piston, or via a motion sensor used to detect the axial stroke position of the piston within the chamber. In other embodiments, the setting tool may include a relatively small volume of fluid in the reservoir or may include a stopping mechanism disposed in the chamber that may stop the piston after allowing it to stroke down by a certain amount.

As noted above, after the packer has initially been set, the pump may be stopped at a point during the setting procedure in order for an operator to perform a test on the packer. To that end, the pump may remove fluid pressure from the cylinder (pressure drop 170), while an operator of the drilling rig at the surface waits a desired amount of time such as, for example, 15 minutes. The tool operator at the surface may then pick up the tubing to apply a tension 172 to ensure that the packer is set. If the tubing is picked up without causing the expected tension increase 172, this may indicate that the packer is not properly set against the wellbore. In some embodiments, the operator may also control the drilling rig to put additional weight down on the tubing to apply a compression to confirm that the packer is properly set in the wellbore. After performing this push and pull test on the packer via the setting tool, the operator may slack off the weight on the setting tool to return the workstring to a neutral strain measurement 174.

At different points throughout the setting procedure or prior to initiating the setting procedure, other tools and components present downhole within the setting tool or proximate the setting tool may be tested. For example, it may be desirable to test a sump packer that is part of the downhole assembly prior to setting the packer. It may be desirable to perform other operations, such as checking to ensure that the sump seals are in the sump packer on a washdown system, or to activate a device (e.g., circulating device or PMD device) on the setting tool prior to setting the packer. Such testing may be performed either prior to the initiation of the packer setting procedure or during one of the stopping points in the setting procedure described above. In some embodiments, the controller in the setting tool may be communicatively coupled to components designed to perform these tests and, therefore, may signal the components at the appropriate time to perform the tests or tool activations.

In some embodiments, the controller may trigger the pump to pressurize fluid (pressure increase 176) within the chamber again to complete the setting of the packer in response to the push and pull test. In this way, the setting tool may utilize the detection of the push and pull test, or some other tension/compression profile, as a signal to re-activate the pump to complete the setting procedure. In some embodiments, the controller may send a control signal to the pump to complete the setting procedure in response to a detected amount of tension or compression being applied to the setting tool. In other embodiments, the controller may send the signal in response to the detected tension or compression exceeding a threshold number of cycles. In further embodiments, the controller may send the signal in response to the detected tension or compression exceeding a threshold number of cycles within a set time period.

The final pressure increase 176 may provide the pressure needed for the setting tool to complete setting the packer. After this, the setting tool may be released from the packer via a release mechanism. In embodiments where the release mechanism is a shear mechanism, the pump may provide a maximum pressure 178 that shears the setting tool away from the fully set packer. However, in other embodiments a torque release may be used to separate the setting tool from the packer.

Although described in the context of strain analysis using a strain gauge or other load cell, it should be noted that other embodiments of the setting tool may utilize other sensor measurements to provide feedback for initiating, halting, and/or re-activating the pump system. For example, some embodiments of the setting tool may include a torque sensor, and an operator may apply a certain torque to the setting tool to activate the pump's setting procedure. In some embodiments, the controller may send a control signal to the pump to perform some part of the setting procedure in response to a detected torque being maintained on the setting tool. In other embodiments, the controller may send the signal in response to a detected rotation of the tool a certain number of times. In still further embodiments, the controller may send a control signal to the pump in response to some combination of load (tension or compression) and torque detected by the sensors.

In some embodiments, it may be desirable to ensure that pressure spikes, loads, or torques on the setting tool during running and circulating operations do not trigger the packer setting routine of the setting tool. To that end, the setting tool may include additional pressure and/or temperature sensors used to provide a confirmation signal to the controller to prevent the setting tool from starting the setting routine too early (e.g., while the tool is at the surface). The setting tool may include a downhole pressure transducer, for example, that may be communicatively coupled to the controller to signal the controller when the pressure transducer measures a downhole pressure (e.g., a threshold pressure higher than surface pressure). Once the pressure transducer measures pressures within the desired downhole range, the controller may begin sampling the tension/compression measurements from the strain gauge for initiation of the setting tool. Similarly, the setting tool may include a temperature sensor that would have to measure appropriate downhole temperatures before the setting tool may start to sample the tension and compression measurements for initiation of the setting procedure. Such temperature and pressure measurements may be used as a failsafe to ensure that the setting tool does not begin its setting routine until it reaches a desired point in the wellbore.

As discussed at length above, the setting tool may be pre-programmed to follow a desired setting procedure, such as setting the packer most of the way, waiting for an operator to apply tension/compression initiated from the surface, then setting the packer the rest of the way. In some embodiments, it may be desirable for the setting tool to provide confirmation that the packer has been fully set. To that end, some embodiments of the setting tool may record the pump pressure and strain gauge readings in a memory of the controller, and this data could be downloaded to the surface. If the data is sent to the surface in real-time or near real-time, operators at the surface may be informed if the setting tool is malfunctioning and if backup techniques may need to be used, such as dropping a ball to divert pressurized fluid to the piston.

Figure 7:
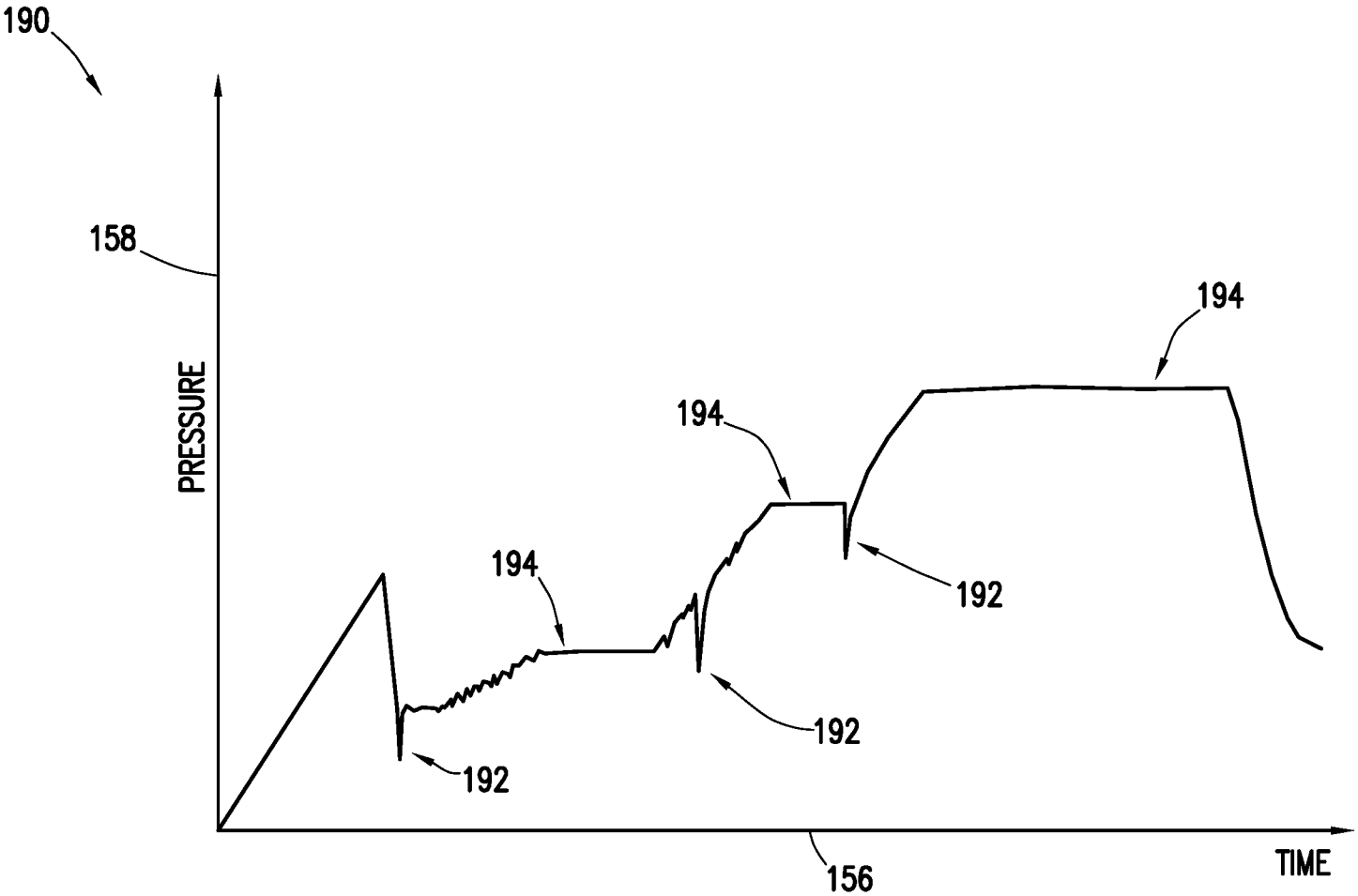
FIG. 7 is a plot illustrating a pressure measurement taken with respect to time to confirm that the packer setting tool of FIG. 2 has set a packer, in accordance with an embodiment of the present disclosure.

FIG. 7 illustrates an example of the type of graph 190 that may be provided to operators at the surface either during or after packer setting operations. The graph 190 shows the detected pressure 158 taken with respect to time 156, similar to the plot of FIG. 6. In the illustrated embodiment, the graph 190 may indicate the setting pressure of the tool at various points throughout the setting procedure, such as at points 192 where certain tool components are sheared during the setting process. In addition, the graph 190 may be used to determine hold times 194 in which the pressure is maintained before initiating a new part of the sequence. The graph 190 may be provided to customers as confirmation that a packer setting tool is working properly and/or a packer has been properly set. The graph 190 may also be used to indicate problems with the packer and/or with the packer setting tool. Thus, the setting tool may be used to record and document the setting process of the packer.

Embodiments disclosed herein include:

A. A packer setting tool for setting a packer in a wellbore. The packer setting tool includes a hydraulic chamber, a piston disposed in the hydraulic chamber, and a pump coupled to the hydraulic chamber via a flow path to pump pressurized fluid into the hydraulic chamber for pushing the piston in an axial direction. The packer setting tool also includes a setting sleeve directly or indirectly coupled to the piston to apply a compressive force to a packer element of the packer when the piston is pushed in the axial direction. An annulus below the packer is in fluid communication with tubing coupled to an upper portion of the packer setting tool.

B. A system including a pump disposed in a setting tool for pressurizing fluid in a chamber of the setting tool to set a packer, and a sensor coupled to a portion of the setting tool to sense a property relating to a workstring coupled to the setting tool. The system also includes a controller communicatively coupled to the sensor to receive a sensor signal indicative of the property sensed via the sensor. The controller is communicatively coupled to the pump to provide a control signal to the pump based on the received sensor signal.

C. A method including directing pressurized fluid into a chamber of a setting tool via an electric pump disposed in the setting tool. The method also includes forcing a piston to move axially through the chamber in response to the pressurized fluid, wherein the piston is coupled to a setting sleeve of the setting tool. In addition, the method includes applying a compressive force to a packer element of a packer via the setting sleeve to set the packer in a wellbore while maintaining an annulus of the wellbore below the packer in fluid communication with tubing coupled to an upper portion of the setting tool.

Each of the embodiments A, B, and C may have one or more of the following additional elements in combination: Element 1: further including a battery coupled to the pump for providing operational power to the pump. Element 2: further including a sensor for sensing a strain, pressure, or torque exerted on the packer setting tool, and a controller communicatively coupled to the sensor and to the pump for providing a control signal to operate the pump based on feedback from the sensor. Element 3: wherein the controller includes a processor to execute a setting sequence to determine the control signal for operating the pump based on the feedback from the sensor. Element 4: wherein the controller includes a memory for logging the feedback from the sensor. Element 5: further including a controller disposed at the surface and communicatively coupled to the pump for providing a control signal to operate the pump. Element 6: wherein the pump is coupled to the hydraulic chamber to pump filtered well fluids from the wellbore into the chamber. Element 7: further including a reservoir of hydraulic fluid, wherein the pump is coupled to the reservoir to pump the hydraulic fluid from the reservoir into the hydraulic chamber. Element 8: further including a return fluid flow path coupled to a first side of the hydraulic chamber on one side of the piston, wherein the pump is coupled to a second side of the hydraulic chamber on an opposite side of the piston to pump the pressurized fluid into the second side of the hydraulic chamber. Element 9: further including a backup setting mechanism including a ball seat disposed in a central flowpath of the packer setting tool. Element 10: wherein the pump is a reversible pump.

Element 11: wherein the sensor includes a pressure sensor, a temperature sensor, a torque sensor, a strain gauge, a magnetic sensor, a materials sensor, a radioactivity sensor, or some combination thereof. Element 12: wherein the sensor is coupled to the setting tool to collect a temperature measurement, a pressure measurement, or both to determine whether the setting tool is positioned downhole. Element 13: wherein the controller is communicatively coupled to the pump to provide a control signal to the pump to activate a setting procedure of the pump when the received sensor signal conforms to a pre-programmed setting sequence. Element 14: further including a releasing mechanism for disconnecting the setting tool from the packer via an applied pressure or rotation.

Element 15: further including maintaining fluid communication between the annulus of the wellbore below the packer and the tubing without blocking a central flow path of the tubing. Element 16: further including maintaining fluid communication between the annulus of the wellbore below the packer and the tubing without blocking the tubing with a ball, a plug, a wireline valve, or a ball valve. Element 17: further including applying the compressive force to the packer element to set the packer in the wellbore without altering a pressure in the tubing. Element 18: further including controlling an operation of the electric pump based on sensor feedback from one or more sensors disposed in the setting tool. Element 19: further including collecting a pressure, strain, torque, or temperature measurement, or a combination thereof, via the one or more sensors disposed in the setting tool, receiving a sensor signal from the one or more sensors at the controller, and outputting a control signal to the electric pump based on the sensor signal via the controller. Element 20: further including controlling an operation of the electric pump based on a command sent from the surface via the tubing. Element 21: further including applying a first compressive force to the packer element via the setting sleeve to partially set the packer, stopping movement of the piston and the setting sleeve when the setting sleeve is partially set, detecting a trigger via one or more sensors in the setting tool, and applying the compressive force to the packer element to fully set the packer in response to detecting the trigger. Element 22: further including disengaging the setting tool from the packer after setting the packer in the wellbore. Element 23: further including maintaining a flow of fluid through a central flowline disposed through a length of the setting tool while setting the packer. Element 24: further including directing the pressurized fluid from a reservoir disposed in the setting tool into the chamber.

Although the present disclosure and its advantages have been described in detail, it should be understood that various changes, substitutions and alterations can be made herein without departing from the spirit and scope of the disclosure as defined by the following claims.

What is claimed is:

1. A packer setting tool for setting a packer in a wellbore, the packer setting tool comprising:

a mandrel with a bore formed therethrough at least partially defining a central flowbore of the packer setting tool;

a housing disposed around the mandrel and defining a hydraulic chamber within the packer setting tool;

a piston disposed in the hydraulic chamber;

a pump coupled to the hydraulic chamber via a flow path to pump pressurized fluid into the hydraulic chamber for pushing the piston in an axial direction;

a setting sleeve coupled to the piston to apply a compressive force to a packer element of the packer in response to the piston being pushed by the pump in the axial direction toward the packer element;

a sensor coupled to a portion of the packer setting tool, wherein the sensor detects a strain exerted on the mandrel of the packer setting tool or a torque applied to the packer setting tool; and a controller communicatively coupled to the sensor and to the pump, wherein the controller provides a control signal to operate the pump based on feedback from the sensor;

wherein an annulus below the packer is in fluid communication with tubing coupled to an upper portion of the packer setting tool.

2. The packer setting tool of claim 1, further comprising a battery coupled to the pump for providing operational power to the pump.

3. The packer setting tool of claim 1, wherein the controller comprises a memory for logging the feedback from the sensor.

4. The packer setting tool of claim 1, further comprising a controller disposed at the surface and communicatively coupled to the pump for providing a control signal to operate the pump.

5. The packer setting tool of claim 1, wherein the pump is coupled to the hydraulic chamber to pump filtered well fluids from the wellbore into the chamber.

6. The packer setting tool of claim 1, further comprising a reservoir of hydraulic fluid, wherein the pump is coupled to the reservoir to pump the hydraulic fluid from the reservoir into the hydraulic chamber.

7. The packer setting tool of claim 1, wherein the piston is sealed against the housing and against the mandrel within the hydraulic chamber, and wherein the hydraulic chamber on a first side of the piston is fluidly connected to the flow path.

8. The packer setting tool of claim 7, further comprising a driving mechanism directly coupled to the piston and coupled to the setting sleeve, wherein the driving mechanism extends in an axial direction within a space between the mandrel and the housing.

9. The packer setting tool of claim 8, further comprising a centralizing member coupled to the setting sleeve, wherein the centralizing member is connected to the driving mechanism via a releasing mechanism that can be activated to release the driving mechanism from the centralizing member after the packer is set.

10. The packer setting tool of claim 8, further comprising a port formed through the driving mechanism fluidly connecting a second chamber formed between the mandrel and the driving mechanism to the hydraulic chamber on a second side of the piston opposite the first side.

11. The packer setting tool of claim 7, wherein the hydraulic chamber on a second side of the piston opposite the first side is open to fluid surrounding the housing.

12. The packer setting tool of claim 7, further comprising an isolation sleeve disposed within the bore formed through the mandrel and coupled to the mandrel, wherein the isolation sleeve comprises a port formed therethrough and a ball seat, wherein upon landing a ball on the ball seat and pressurizing up the central flowbore, the isolation sleeve shifts to a position such that the port through the isolation sleeve aligns with a port extending through the mandrel to the hydraulic chamber on the first side of the piston.

13. A system, comprising:

a pump disposed in a setting tool for pressurizing fluid in a chamber formed in the setting tool to set a packer;

a sensor comprising a strain or torque sensor coupled to a portion of the setting tool to sense a strain exerted on a mandrel of the setting tool or a torque applied to the setting tool; and a controller communicatively coupled to the sensor to receive a sensor signal indicative of the strain or torque sensed via the sensor, wherein the controller is communicatively coupled to the pump to provide a control signal to the pump based on the received sensor signal.

14. The system of claim 13, further comprising a pressure sensor or a temperature sensor coupled to the setting tool and communicatively coupled to the controller, wherein the controller determines whether the setting tool is positioned at a desired downhole location based on a sensor signal received from the pressure sensor or temperature sensor.

15. The system of claim 13, wherein the controller is communicatively coupled to the pump to provide a control signal to the pump to activate a setting procedure of the pump in response to the received sensor signal conforming to a pre-programmed setting sequence, wherein the pre-programmed setting sequence includes a first tension or compression exerted on the setting tool followed by a second tension or compression exerted on the setting tool.

16. A method, comprising:

detecting a strain exerted on a mandrel of a setting tool or a torque applied to the setting tool via a sensor coupled to the setting tool;

receiving a sensor signal from the sensor at a controller; and outputting a control signal from the controller to an electric pump disposed in the setting tool, based on the sensor signal;

directing pressurized fluid into a chamber formed in the setting tool via the electric pump in response to the control signal;

forcing a piston to move axially through the chamber in response to the pressurized fluid, wherein the piston is coupled to a setting sleeve of the setting tool; and applying a compressive force to a packer element of a packer via the setting sleeve to set the packer in a wellbore while maintaining an annulus of the wellbore below the packer in fluid communication with tubing coupled to an upper portion of the setting tool.

17. The method of claim 16, further comprising maintaining fluid communication between the annulus of the wellbore below the packer and the tubing without blocking a central flow path of the tubing.

18. The method of claim 16, further comprising applying the compressive force to the packer element to set the packer in the wellbore without altering a pressure in the tubing.

19. The method of claim 16, further comprising:

applying a first compressive force to the packer element via the setting sleeve to partially set the packer;

stopping movement of the piston and the setting sleeve at a partially set position, wherein the packer is not fully set in the wellbore when the setting sleeve is at the partially set position;

detecting a trigger via one or more sensors in the setting tool; and applying additional compressive force to the packer element to fully set the packer in the wellbore in response to detecting the trigger.

20. The method of claim 16, further comprising disengaging the setting tool from the packer after setting the packer in the wellbore.

* * * * *